United States Patent [19]

Brennan

[11] Patent Number: 4,546,851

[45] Date of Patent: Oct. 15, 1985

[54] TREE CLIMBING APPARATUS

[76] Inventor: Daniel F. Brennan, 512 Main St., Shoemakersville, Pa. 19555

[21] Appl. No.: 438,942

[22] Filed: Nov. 3, 1982

[51] Int. Cl.[4] ..... A62B 1/16; A62B 35/00

[52] U.S. Cl. ..... 182/7; 188/65.2

[58] Field of Search ..... 182/3, 5, 6, 7, 8, 9, 182/191, 192, 142; 188/65.1-65.5

[56] References Cited

U.S. PATENT DOCUMENTS

| | | | |
|---|---|---|---|
| 259,279 | 6/1882 | Rose et al. | 182/192 |
| 269,268 | 12/1882 | Davis | 182/7 |
| 276,730 | 5/1883 | Sturtevant | 182/6 |
| 424,550 | 4/1890 | Hahn | 182/5 |
| 2,252,998 | 8/1941 | Watchel | 182/6 |
| 2,254,179 | 8/1941 | Hoyt | 182/7 |
| 4,120,377 | 10/1978 | Charles et al. | 182/3 |
| 4,273,215 | 6/1981 | Leggett | 182/3 |

FOREIGN PATENT DOCUMENTS

| | | | |
|---|---|---|---|
| 1169819 | 5/1964 | Fed. Rep. of Germany | 182/5 |
| 792288 | 10/1935 | France | 182/7 |

*Primary Examiner*—Reinaldo P. Machado
*Attorney, Agent, or Firm*—Irvin A. Lavine

[57] ABSTRACT

Tree climbing apparatus includes a seat, a rope supporting the seat and a cleat. One end of the rope supports the seat, a standing portion of the rope extends upwardly from the seat; the rope passes over a branch, and a running portion extends downwardly and through a uni-directional cleat; a a link supports the seat from the cleat. The cleat is laterally removable from the running portion, for replacement by a latching rope extending from the seat to the suspension rope running portion.

17 Claims, 7 Drawing Figures

TREE CLIMBING APPARATUS

BACKGROUND OF THE INVENTION

The present invention relates to tree climbing apparatus, and more particularly to such apparatus for enabling a person to climb a tree so as to be located at a substantial height above the ground.

The utilization of riggings, including ropes, to enable persons to reach elevated positions have long been known. These include the boatswain's chair used on sailing vessels, and similar arrangements utilized for performing work in trees and on towers, poles, and the like.

An example of a boatswain's chair construction is disclosed in Hoyt U.S. Pat. No. 2,254,179, in which there is a seat, a spreader above the seat, a belt for encircling the waist of the user, suspension elements between the spreader and the seat, and connectors between the belt and the suspension elements. In addition, a rope is provided, connected to the spreader, with a tail of the rope extending from the spreader and being used as a lanyard, there being disclosed a knot enabling the lanyard to connect the spreader to the running portion of the rope. While this construction is of light-weight, it requires that the climber tie the knot in the lanyard around the running portion of the rope, a task which apparently must be accomplished with one hand while the other hand holds the running portion of the rope to and thereby insures the suspension of the climber while he is tying the knot of the lanyard.

In addition to the above arrangement, there have been provided a number of constructions for enabling a person to descend a rope in safety, usually for the purpose of escaping from an upper floor of a building, as during a fire. These constructions included, in many cases, a cleat arrangement, to permit a person either to remain stationary on a rope which had an upper end attached to a support above the person, or to permit the person to descend along the rope, by releasing the cleat. In these constructions, there was no provision for climbing the rope, since in these fire escape devices and safety devices, the intent was to permit the person to descend from an upper elevation. Among the disclosures of the latter type are Davis U.S. Pat. No. 269,268, Rose et al U.S. Pat. No. 259,279 and Hahn et al U.S. Pat. No. 424,550.

SUMMARY OF THE INVENTION

The present invention is directed to a tree climbing apparatus, and includes, when in use, a seat apparatus, including a seat, a safety belt, and a spreader bar. The spreader bar is provided with snap hooks on the end, for safety, and a passage in the middle for receiving the end portion of a rope. The rope extends upwardly, thereby providing a standing portion, passes over a generally horizontal support, such as a tree limb, and then extends downwardly, the downwardly extending portion being designated as the running portion. A cleat is provided on the running portion, which permits the running portion to move only downwardly, thereby decreasing the distance, along the rope, between the seat and the cleat. The cleat is provided with an axial rope path therethrough, and is also provided with a transverse passage from the exterior laterally to the axial rope path. This permits the cleat to be engaged and disengaged from the running portion of the rope by movement transverse to the rope. To prevent accidental separation, the cleat is provided with a pair of rope keepers, in the form of rotatable split cylinders concentric with the rope path, so that the opening or split therein may be aligned with the passage, or not, as desired. The cleat is provided with a pair of releasable snap hooks, connected to it by swivels, and extending generally laterally of the cleat, so as to releasably engage the standing portion of the rope, thereby to hold the cleat, and the running portion of the rope therein, relatively close to the standing portion, and parallel to it. A link, in the form of a rope having a loop at its upper end, extends generally upwardly from the spreader bar, and passes over an upwardly facing hook extending from the cleat. As a safety measure, one of the releasable snap hooks is connected to the upwardly facing hook, so that the loop of the link must be passed over the releasable snap hook prior to being placed on the upwardly facing hook. A latching rope extends from the spreader bar to the running portion, and is used to replace the cleat, to permit descent of the user.

Among the objects of the present invention are the provision of a tree climbing apparatus which is extremely safe, in that the user may be securely held at an elevated position while fashioning a suitable knot in a latching rope. Another object of the is to provide a tree climbing apparatus which is light in weight, and comfortable to use over a long period of time. Another object of the present invention is to provide a tree climbing apparatus which will permit relatively rapid assent and descent of a user thereof.

Other objects and many of the attendant advantages of the present invention will be readily understood from the consideration of the following specification, claims and drawings.

DESCRIPTION OF THE PREFERRED EMBODIMENT

Figure 1:
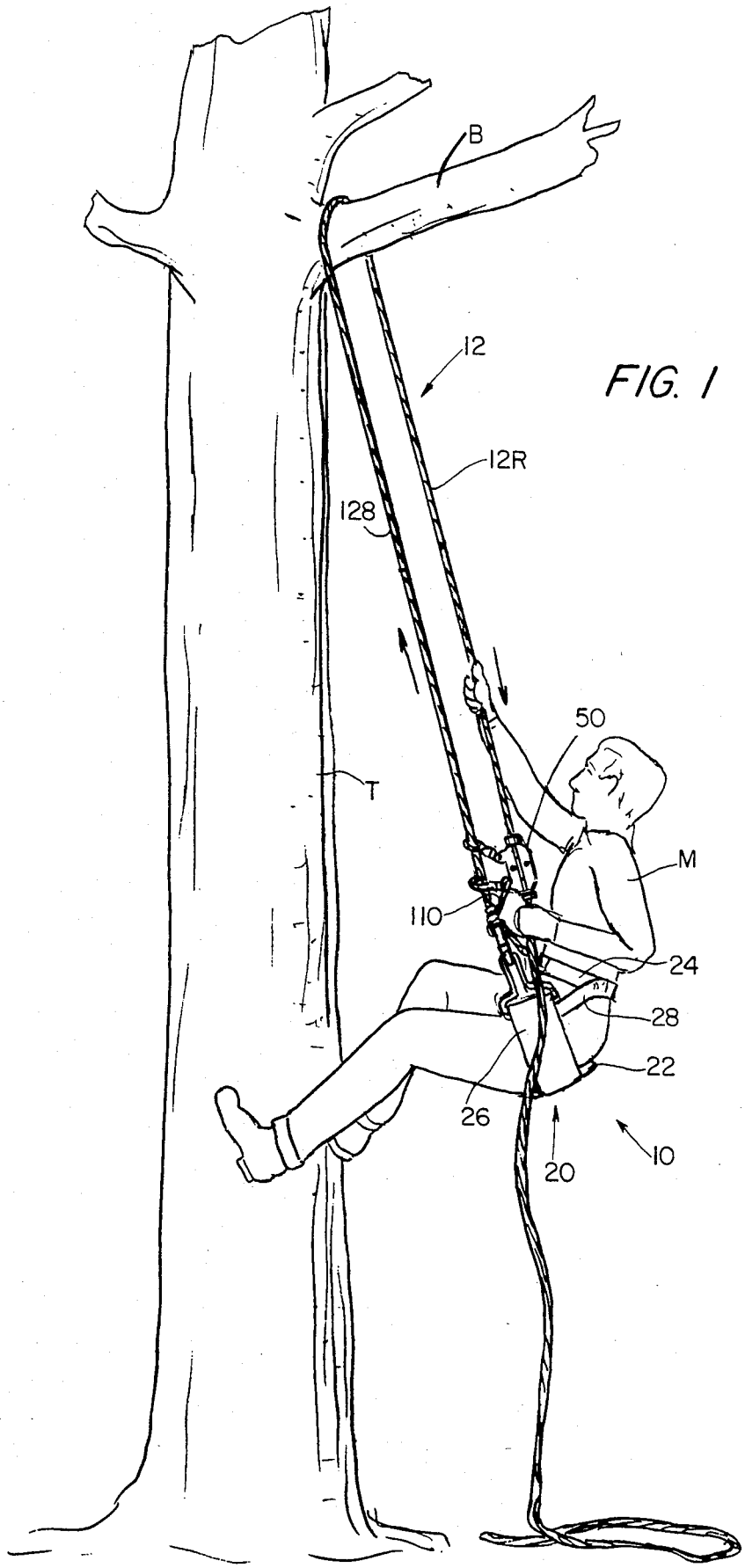
FIG. 1 is a perspective view of a tree climbing apparatus in accordance with the present invention, in use.

Referring now to the drawings, wherein like or corresponding reference numerals are used to designate like or corresponding parts throughout the several views, there is shown in FIG. 1 a tree climbing apparatus 10 being used by a man M to climb a tree T. As shown therein, the tree climbing apparatus 10 includes a suspension rope 12, having a standing portion 12S and a running portion 12R, the rope 12 being looped or passed over a branch B of tree T. The man M is supported by a seat apparatus generally designated 20, which includes seat 22, belt 24, suspension strap 26 and connecting strap 28. Also shown is a cleat 50. As will be noted, the running portion 12R extends through the cleat 50, and its lower end reaches the ground. If desired, equipment useful to the man M when he has reached the elevated position in the tree may be attached to the end of the running portion 12R which is at or adjacent the gound, so that such equipment may be retrieved by the man M after he has achieved his elevated position. In particular, such equipment may be a rifle, ammunition, food, etc., which would be particularly useful where the man M is climbing tree T for purposes of hunting, such as for deer hunting.

Figure 2:
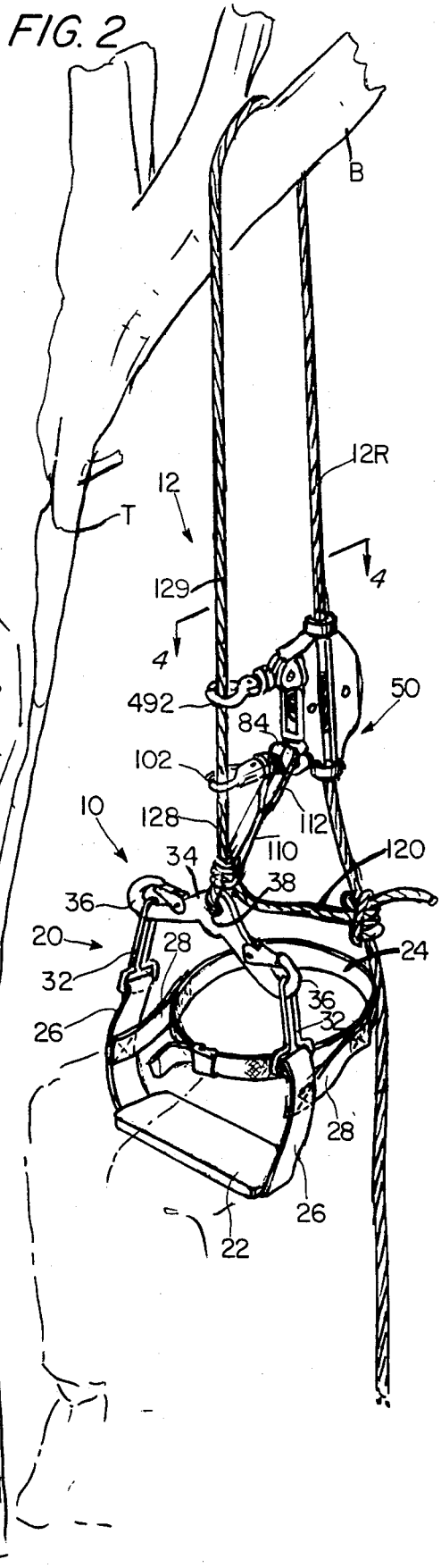
FIG. 2 is a perspective view, showing details of the tree climbing apparatus of FIG. 1.

Referring now to FIG. 2, there may be seen the apparatus 10, with further disclosure of the seat means 20. The seat 22 is shown with the belt 24 thereabove, and the suspension straps 26 extending from each end of seat 22 in spaced relation, the connecting straps 28 being joined to the belt 24 and to the two suspension straps 26. Forming part of or attached to the suspension straps 26 are connectors 32 having lower loops for engagement by the suspension straps 26, and having, also, upper loops. A spreader bar 34 is provided, having latch hooks 36 at each end thereof, and having an opening 38 at the mid-part thereof.

The lower end portion of the suspension rope 12, and particularly the standing portion 12S thereof is connected to the spreader bar 34 by being passed through the opening 38, a suitable knot being tied so as to secure suspension rope 12 to spreader bar 34. There may also be seen in FIG. 2 the cleat 50.

Figure 3:
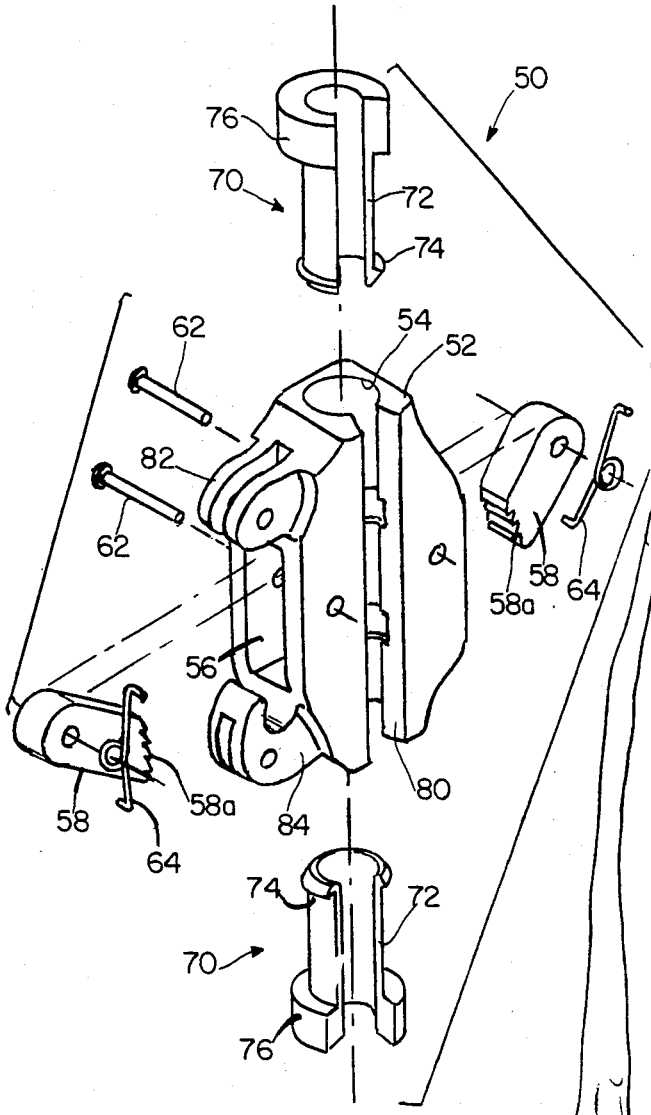
FIG. 3 is an exploded view of a cleat forming a part of the tree climbing apparatus shown in FIGS. 1 and 2.
Figure 5:
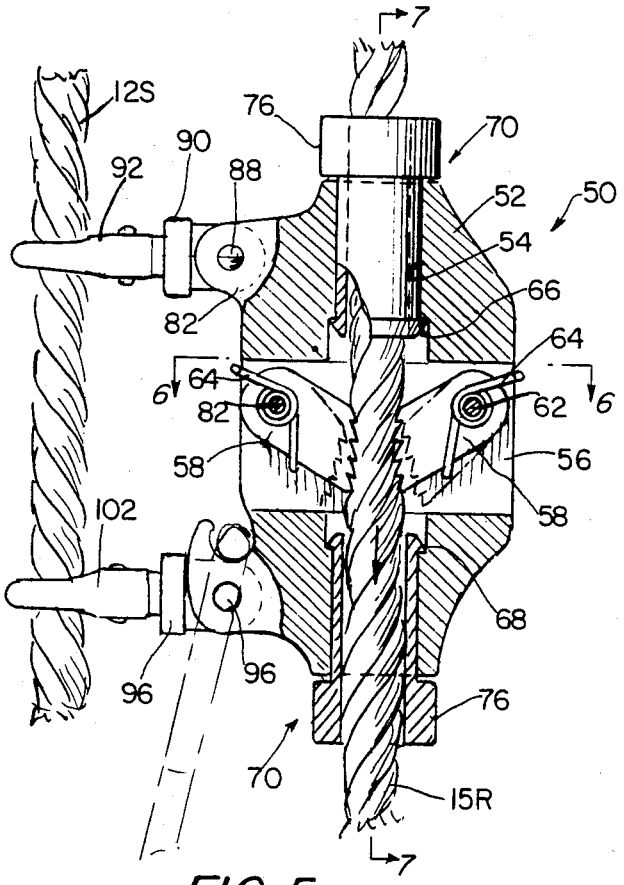
FIG. 5 is a view, partly in section, of the structure shown in FIG. 4, taken on the line 5—5 of FIG. 4.

Referring to FIG. 3, cleat 50 comprises a body 52 having an axial passage 54 extending therethrough. Referring to FIG. 5, also, a transverse cavity 56 is provided in the body 52, and a pair of dogs 58 are provided in cavity 56, each supported on a pivot pin 62, which passes through suitable holes in each of the dogs and through holes in the body 52. Springs 64 are provided on each of the pivot pins 62, the springs 64 engaging the dogs 58 and also the body 52 to urge the toothed inner ends **58*a* of dogs 58 inwardly, towards the rope path 54 so as to engage the suspension rope running portion 12R. As will be understood, due to the inclination of the dogs 58, suspension rope running portion 12R may be moved only in the direction indicated by the arrows in FIG. 5, movement in the opposite direction being prevented by the inward, clamping action of the dogs 58**.

Referring to FIG. 5, above the cavity 56 there is shown a downwardly facing shoulder 66, and below the cavity 56 there is shown an upwardly facing shoulder 68, both in surrounding relationship to the axial rope path 54. A split cylindrical rope keeper 70 is provided in the upper portion of the axial rope path 54, having an axially extending opening or split 72 (see FIG. 3) therein, and having an upwardly facing shoulder 74 at the lower end thereof, which engages the downwardly facing shoulder 66 of body 52. A head 76 is provided on the rope keeper 70, for engagement by the fingers of the man M, so as to rotate it on its axis, it being understood that the rope keeper 70 is concentric with the rope path 54. An identical keeper 70 is provided in the lower part of the body 52, the shoulder 74 engaging the upwardly facing shoulder 68. Thus, the rope keepers 70 may be rotated on their axes, but may not be moved axially and are thereby retained within the body 52.

The body 52 are provided with a passage 80 which extends thereinto from the exterior thereof, connecting the exterior with te axial rope path 54. Thus, when the rope keepers are in the position shown in FIG. 3, with their slits or openings 72 in alignment with the passage 80, the rope 12 may be passed laterally or transversely into and out of the cleat 50, and upon rotation of the keepers 70, such lateral or transverse movement is prevented.

Figure 4:
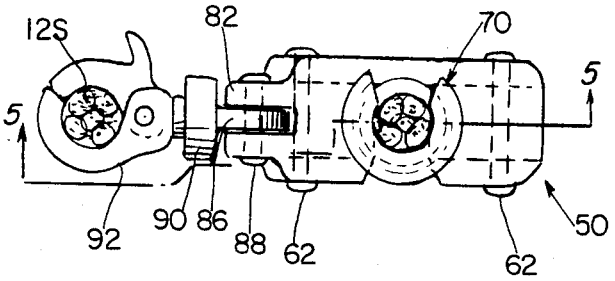
FIG. 4 is a cross-sectional view taken on the line 4—4 of FIG. 2.

The body 52 has an upper, split projecting ear 82, and a lower, split projecting ear 84, the latter being in the form of an upwardly facing hook. Both ears 82 and 84 have openings transversely extending through them. As shown in FIG. 4, a plate 86 extends into the split ear 82, and is pivotally connected thereto by pin 88, plate 86 carrying at its outer end a swivel 90, which rotatably mounts a releasable snap hook 92 which engages the standing portion 12S of rope 12.

Figure 6:
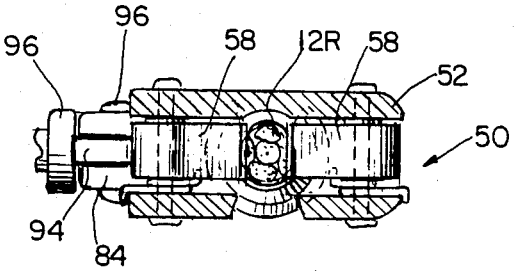
FIG. 6 is a cross-sectional view taken on the line 6—6 of FIG. 5.

As shown in FIGS. 5 and 6, the lower split ear 84 has a plate 94 extending into it and pivotally connected to it by pivot pin 96. Plate 94 carries a swivel 96, and as shown in FIG. 5, swivel 96 supports a releasable snap hook 102. The releasable snap hooks 92 and 102 will be seen to be in engagement with the suspension rope standing portion 12S, and serve to maintain the cleat 50 in adjacent, spaced relation to standing portion 12S, and to maintain the running portion 12R in adjacent parallel relationship portion 12S.

Figure 7:
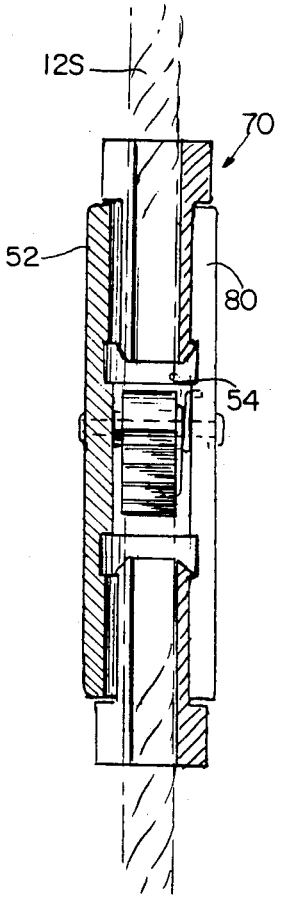
FIG. 7 is a cross-sectional view taken on the line 7—7 of FIG. 5.

In FIG. 7, there is shown the cleat 50 with the running portion 12S extending through the axial rope path 54, and the passage 80 extending from the exterior of body 52 to the rope path 54. While the keepers 70 are shown in the retaining position, as will be understood they may be rotated on their axes, to bring the splits or openings 72 thereof into alignment with the passage 80.

Referring again to FIG. 2, there is shown a link 110 having its lower end connected to the seat 20, and more particularly to the end of the standing portion 12S of rope 12 where it engages the spreader bar 34. Link 110 has a loop 112 in its upper end, which is passed over the upwardly facing hook which forms a portion of the ear 84. The loop 112 must be passed over the releasable snap hook 102 in order to be positioned on the upwardly facing hook of ear 84, and thereby the releasable snap hook 102 and the mounting structure therefor which mounts it on the ear 84 provide a safety against possible dislodgement of the loop 112.

Also shown in FIG. 2 is a latching rope 120, extending from the lower end of the standing portion 12S, and knotted about the running portion 12R; the latching rope 120 is used, as herein below described, to replace the cleat 50 once the man M has raised himself to the desired elevated position.

In operation, the apparatus 10 is carried to the desired location, this being a tree, if, for example, it is the intent to be elevated in the tree for hunting, tree if, for example, it is the intent to be elevated in the tree for hunting, tree pruning, etc. The apparatus 10 may, of course, be utilized in connection with climbing other structures. The rope 12 is then placed over a branch B or other support. This may be done by fastening an end of the rope 12 to a weight, such as the spreader bar 34, and casting it over the branch. The remaining portions of the seat 20 are then connected to the spreader bar 34 and to the man M, by the man M placing the seat 22 behind him and strapping the belt 24 around his waist. The ends of the connectors 32 are then placed on the snap hooks 36 and spreader bar 34. The cleat 50 is placed on the running portion 12R, by first rotating the keepers 70 to open position, then relatively laterally moving cleat 50 and running portion 12R, engaging running portion 12R between the dogs 58, and then rotating the keepers 70 to closed position. The loop 112 of link 110 is then passed over releasable snap hook 102, and engaged on the hook provided by lower ear 84 of cleat 50. The releasable snap hooks 92 and 102 are then positioned on the standing portions 12S of rope 12.

By pulling on running portion 12R, the man M is able to pull himself up the tree T (see FIG. 1). This may be done by pulling on the running portion 12R using one or both hands, and then pulling the slack of running portion 12R through the cleat 50. Upon release of the hands from the rope 12, the man will be suspended by rope 12 through the seat apparatus 20, and through standing portion 12S, as well as through link 110, cleat 50 and running portion 12R above cleat 50. While the cleat 50 has been shown in FIG. 1 to be in front of the chest of the man M, its exact positioning may be varied as desired; this may be accomplished by adjusting the length of the link 110, or by utilizing a link 110 of a suitable, preferred length. This movement of the rope is permitted by unidirectional cleat 50; this movement shortens the rope between seat apparatus 20 and cleat 50. After the man M has thus elevated himself, he may then pull up any equipment which he needs, such as guns, ammunition and the like, by pulling on the end (or tail) of running portion 12R, to which such articles have previously been fastened.

The latching rope is connected to the running portion 12R, by a suitable knot, as shown in FIG. 2, of known type. This knot is sufficient to hold the running portion 12R against movement through it so that the latching rope 120 may serve as a link between seat apparatus 20 and running portion 12R.

By removing weight from running portion 12R, it may be slid up or down through the knot, so as to permit the man M to adjust his position, up or down. In order to descend, the cleat 50 having been removed as above described, more or less finger pressure on the knot of the latching rope 120 will permit more or less rapid descent. After the latching rope 120 has been knotted about the running portion 12R, the cleat 50 is detached from the rope 12. The releasable snap hooks 92 and 102 are disengaged from standing portion 12S, the keepers 70 are rotated, and the cleat thereby moved laterally relative to running portion 12R. Loop 112 is disengaged from lower ear 84. It will be recognized that, during this time, and subsequently, the man M is held in the desired position by the knot in the latching rope 120.

There has been provided a tree climbing apparatus which is of extremely safe construction, which is readily usable and which may be readily transported to remote locations, such as trees, for hunting purposes. The herein disclosed tree climbing apparatus is readily constructed, is of light weight, and is strong and durable.

The term "rope" as used herein will be understood to mean any flaccid member capable of supporting tensile loads.

It will be obvious to those skilled in the art that various changes may be made without departure from the spirit of the invention, and therefore the invention is not limited to that shown in the drawings, described in the specification but only as indicated in the appended claims.

I claim:

1. Tree climbing apparatus for enabling a person to climb a tree, and descend from the tree comprising:

a. a suspension rope, b. seat means connected to said suspension rope adjacent an end thereof, c. unidirectional cleat means engaging said suspension rope remote from said end thereof for permitting movement of said rope in said cleat means only in the direction to enable the rope to be shortened between said seat means and cleat means, said cleat means comprising a body and rope-engaging dogs, upwardly facing hook means on said body, d. link means between said seat means and said body of said cleat means for suspending weight on said seat means through said body of said cleat means to the suspension rope, said link means extending between said hook means and said seat means.

2. The tree climbing apparatus of claim 1 said suspension rope comprising a standing portion extending upwardly from said seat means and a running portion engaged by said dogs of cleat means, and further comprising means for maintaining said cleat means in adjacent relationship to said standing portion.

3. The tree climbing apparatus of claim 2, said last mentioned means comprising releasable hook means for engaging said standing portion of said suspension rope, and means for supporting said releasable hook means on said cleat means.

4. The tree climbing apparatus of claim 3, said hook supporting means comprising swivel means.

5. The tree climbing apparatus of claim 1 said seat means comprising a seat, a spreader bar above said seat, and spaced suspension means connecting an end of said seat with an end of said spreader bar.

6. The tree climbing apparatus of claim 5, said spaced means comprising a pair of spaced suspension straps.

7. The tree climbing apparatus of claim 6, said seat means further comprising a belt, and a pair of connecting straps each extending between said belt and one of said suspension straps.

8. The tree climbing apparatus of claim 5, said spreader bar means comprising hook means at each end thereof each for receiving said suspension means.

9. The tree climbing apparatus of claim 8, said spreader bar means further comprising means for engagement by said rope.

10. The tree climbing apparatus of claim 1, said seat means comprising a spreader bar and a seat, means for suspending said seat from said spreader bar, said link means connected to said spreader bar.

11. The tree climbing apparatus of claim 10, said link comprising a loop on said upwardly facing hook means, and releasable safety means for said hook comprising releasable hook means for engaging said rope, and means connecting said releasable hook means to said upwardly facing hook means.

12. The tree climbing apparatus of claim 1, said unidirectional cleat means comprising means for permitting disengagement of said rope therefrom.

13. The tree climbing apparatus of claim 12, said last mentioned means comprising means defining an axial rope path through said body, and means for permitting lateral movement of said rope into and out of said rope path.

14. The tree climbing apparatus of claim 13, said last mentioned means comprising passage means extending from the exterior of said body thereinto to said rope path.

15. The tree climbing apparatus of claim 14, and further comprising keeper means for selectively opening and closing said passage means.

16. The tree climbing apparatus of claim 15, said last mentioned means comprising at least one axially split cylindrical element having an axial opening therein, and means rotatably mounting said element on said cleat means concentrically of said rope path for selective alignment of the opening therein with said passage means.

17. The tree climbing apparatus of claim 12, and latching rope means extending from said seat means to said rope.

* * * * *